US011352572B2

(12) United States Patent
Chu et al.

(10) Patent No.: US 11,352,572 B2
(45) Date of Patent: Jun. 7, 2022

(54) LOW VISCOSITY POLY-A-OLEFIN LUBRICATING OIL AND SYNTHESIS METHOD THEREOF

(71) Applicant: PETROCHINA COMPANY LIMITED, Beijing (CN)

(72) Inventors: Hongling Chu, Beijing (CN); Sihan Wang, Beijing (CN); Kecun Ma, Beijing (CN); Xianming Xu, Beijing (CN); Libo Wang, Beijing (CN); Guizhi Wang, Beijing (CN); Yan Jiang, Beijing (CN); Legang Feng, Beijing (CN); Yulong Wang, Beijing (CN); Enhao Sun, Beijing (CN); Hongliang Huo, Beijing (CN); Tong Liu, Beijing (CN); Yali Wang, Beijing (CN); Xiuhui Wang, Beijing (CN); Han Gao, Beijing (CN); Yuanyuan Cao, Beijing (CN); Fengrong Wang, Beijing (CN); Weihong Guan, Beijing (CN); Ruhai Lin, Beijing (CN); Xuemei Han, Beijing (CN); Yunguang Han, Beijing (CN); Fuling Huang, Beijing (CN); Buwei Yu, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 108 days.

(21) Appl. No.: 16/663,128

(22) Filed: Oct. 24, 2019

(65) Prior Publication Data

US 2020/0190409 A1 Jun. 18, 2020

(30) Foreign Application Priority Data

Dec. 14, 2018 (CN) ..... 201811531933.8

(51) Int. Cl.
*C10G 50/02* (2006.01)

(52) U.S. Cl.
CPC ..... *C10G 50/02* (2013.01); *C10G 2300/1088* (2013.01); *C10G 2400/10* (2013.01); *C10G 2400/22* (2013.01)

(58) Field of Classification Search
CPC ..... C10G 50/02; C10G 2400/22; C10G 2400/10; C10G 2300/1088; C08F 2/00;
(Continued)

(56) References Cited

U.S. PATENT DOCUMENTS 2,148,115 A 2/1939 Gerhart et al.
3,742,082 A 6/1973 Brennan
(Continued)

FOREIGN PATENT DOCUMENTS

CN 101054332 A 10/2007
CN 102776022 A 11/2012
(Continued)

OTHER PUBLICATIONS

Chinese Novelty Search Report and English-language translation, 8 pages (dated Nov. 12, 2018).
(Continued)

*Primary Examiner* — Thuan D Dang
(74) *Attorney, Agent, or Firm* — Foley & Lardner LLP

(57) ABSTRACT

The present invention provides a low viscosity poly-α-olefin lubricating oil and a synthesis method thereof. The method comprises: (1) the α-olefin raw material is subjected to dehydration treatment so that the water content in the raw material is ≤10 ppm; (2) a reaction of the dehydration treated α-olefin raw material is carried out in the presence of a complex catalyst and gaseous $BF_3$ to obtain a reaction product, wherein the pressure of the gaseous $BF_3$ is 0.01 to 1 MPa; (3) the reaction product obtained in step (2) is
(Continued)

sequentially subjected to flash distillation, gas stripping, centrifugation, and washing treatment to obtain an intermediate product; (4) the intermediate product obtained in step (3) is subjected to distillation under reduced pressure to separate the unreacted α-olefin raw material and α-olefin dimers, and the remaining heavy fractions are subjected to hydrogenation saturation treatment followed by fractionation and cutting-off.

19 Claims, 1 Drawing Sheet

(58) Field of Classification Search
CPC ..... C08F 4/14; C08F 110/14; C10M 107/10; C10M 2205/0285
See application file for complete search history.

(56) References Cited

U.S. PATENT DOCUMENTS

| | | | | |
|---|---|---|---|---|
| 3,763,244 | A | | 10/1973 | Shubkin |
| 4,045,508 | A | * | 8/1977 | Cuppies ..... C07C 2/20 585/511 |
| 4,227,027 | A | | 10/1980 | Booth et al. |
| 4,409,415 | A | | 10/1983 | Morganson et al. |
| 4,982,042 | A | | 1/1991 | Akatsu et al. |
| 5,068,487 | A | | 11/1991 | Theriot |
| 5,191,140 | A | | 3/1993 | Akatsu et al. |
| 5,254,784 | A | | 10/1993 | Nurminen et al. |
| 5,811,616 | A | | 9/1998 | Holud et al. |
| 6,075,174 | A | | 6/2000 | Presedo |
| 6,410,812 | B1 | | 6/2002 | Hope et al. |
| 6,939,943 | B2 | | 9/2005 | Wettling et al. |
| 2017/0334806 | A1 | | 11/2017 | Agee |

FOREIGN PATENT DOCUMENTS

| | | | |
|---|---|---|---|
| CN | 106957677 | A | 7/2017 |
| CN | 107304237 | | 10/2017 |
| CN | 108251155 | A | 7/2018 |
| CN | 108929186 | | 12/2018 |
| DE | 69604765.3 | | 11/2000 |
| EP | 0 771 13 | A1 | 4/1983 |
| HK | 1007257 | A1 | 4/1999 |
| HU | 9600323 | | 1/1998 |
| JP | 19-90045429-62 | | 10/1990 |
| JP | 2009/0531517 | | 9/2009 |
| WO | WO-2005/023419 | | 3/2005 |

OTHER PUBLICATIONS

Chu et al., "Synthesis of low viscosity poly-alpha-olefins lubricant base oil from boron trifluoride/acetic acid catalyzed I-decene," Chemical Industry and Engineering Progress, vol. 37, No. 8, pp. 3016-3020 (2018).
Notice of Reasons for Refusal for JP Appl. No. 2019-164359 dated Sep. 15, 2020 (6 pages).
Combined Search and Examination Report dated May 28, 2020 for counterpart UK patent application No. 1918007.4. 4 Pages.
First Office Action and Search Report for CN 201811531933.8 dated Aug. 2, 2021 (15 pages).
Wang, Xiaobao, "Inorganic Chemical Technology", May 30, 2005, pp. 137-138 (4 pages).
Second Office Action and Search Report for CN 201811531933.8 dated Feb. 25, 2022 (20 pages).

* cited by examiner

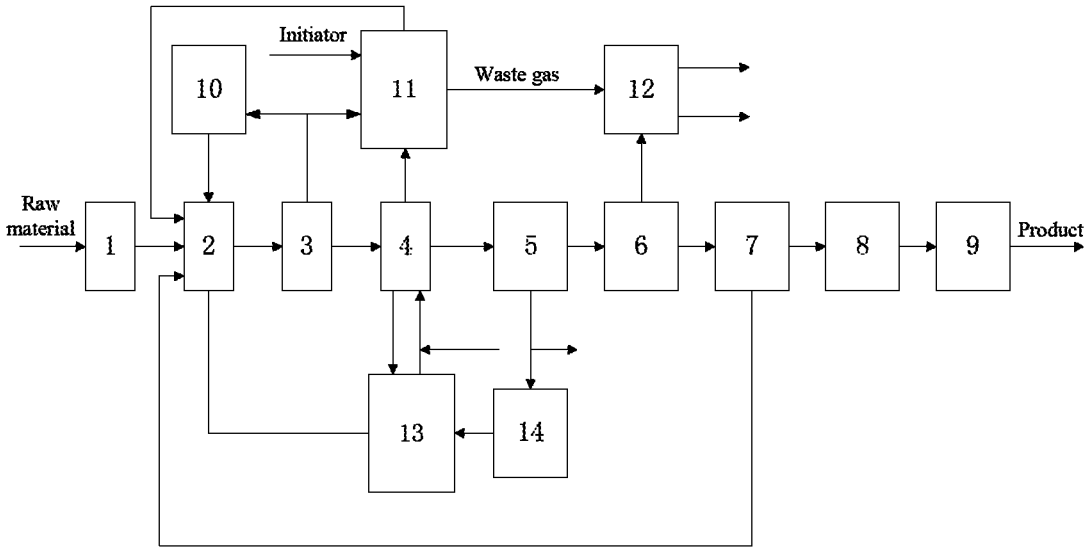
Initiator
10
11
Waste gas
12
Raw material
1
2
3
4
5
6
7
8
9
Product
13
14

LOW VISCOSITY POLY-A-OLEFIN LUBRICATING OIL AND SYNTHESIS METHOD THEREOF

CROSS-REFERENCE TO RELATED APPLICATION

This application claims priority to Chinese Patent Application No. 201811531933.8, filed on Dec. 14, 2018, which is incorporated herein by reference in its entirety.

TECHNICAL FIELD

The present invention pertains to the field of petroleum chemical engineering, more particularly, to a low viscosity poly-α-olefin lubricating oil and the synthesis method thereof. 114364

BACKGROUND

For techniques of synthesis of low viscosity poly-α-olefin lubricating oils and catalyst recovery, many relevant technical literatures and patents have been published domestically and abroad.

U.S. Pat. No. 3,763,244 discloses a method of preparing low pour-point lubricant oils by catalysis of conventional C6-C16 α-olefins with a $BF_3$/water system. U.S. Pat. No. 5,191,140A provides a product having a kinematic viscosity at 100° C. of 3.58 cSt and a viscosity index of 125 when water and acetic anhydride are used as co-catalysts, with an olefin conversion rate of 76.8%. U.S. Pat. No. 3,742,082 discloses a method of synthesizing olefin dimers by catalysis of C6-C10 α-olefins, particularly 1-decene, with $BF_3$ as a catalyst and phosphoric acid or water as a co-catalyst, wherein the molar ratio between the catalyst and the olefin is 0.005:1 to 0.1:1 and the reaction temperature is 100 to 150° C. These above patents use water or water and other materials as co-catalysts to lower to manufacturing cost, but erosion problems tend to occur, while the cost of apparatus investment may greatly increase in order to raise the erosion-resistance grade of the materials; thus, to avoid erosion in the apparatuses and pipelines, lower the investment in apparatuses, maintain a steady operation of the apparatuses in a long term, and reduce the water content in raw materials, it is necessary to reduce erosion.

U.S. Pat. No. 6,939,943 discloses a method for deactivation and recycling of boron trifluoride in polyisobutylene preparation, in which method methanol, ethanol, or a mixture of methanol and ethanol are added into the reaction product to enrich $BF_3$ in the precipitated product for separation, and the resultant is allowed to stand still for settlement and separation, and then the alcohols are separated from $BF_3$ before recycling in a suitable manner. U.S. Pat. No. 4,227,027 discloses a method in which a polyhydric alcohol comprising 2 or more hydrocarbon groups is added into a reaction mixture containing a boron trifluoride complex catalyst where the polyhydric alcohol reacts only with the boron trifluoride in the complex catalyst in an addition reaction to produce a precipitate, thereby removing boron trifluoride, and then the boron trifluoride is recycled by decomposing the addition product under heating. In this method, impurities may be incorporated, which tends to cause accumulation of the catalyst.

JPH02-45429 discloses a process of conducting an alkylation reaction of olefins and an aromatic compound using a boron trifluoride ether complex as catalyst, in which method a weak acid such as phosphoric acid, acetic acid, and phenol is added into the reaction system in an amount of 0.05 to 2 mole with regard to the boron trifluoride ether complex into the reaction system at room temperature at several stages before or after the reaction, and then the post-reaction system is allowed to stand still for separation so that the catalyst portion is layered, and the catalyst layer thus separated is used as is for the next process of alkylation reaction as the catalyst. Catalyst impurities are brought into the process.

Hironaka et al. has discovered that fluorinated alkanes can dissolve $BF_3$ complexes, the fluorinated alkanes having the formula represented by CnHmF2n−m+2. An extracting reagent is added into the reaction solution of a polymerization reaction, with one layer being a layer containing $BF_3$ and $BF_3$ complexes and the other being the reaction product layer, and the $BF_3$ and $BF_3$ complexes separated by distillation from the solvent layer comprising catalyst are returned to the reaction system for repeated us. This approach may bring fluorinated alkane impurities while increasing a separation process and operation cost.

In a process of U.S. Pat. No. 6,410,812B1, $BF_3$ in the flash distilled gas at the top of the recovery flash distillation tank is separated by complexation with alcohols such as butanol, with the liquid at the bottom enters a parallel coalescer for the separation of $BF_3$ complexes in the recovered product. This process is good except for high tendency of the excessive accumulation of the $BF_3$ complexes.

A flash distillation/evaporation process is used in U.S. Pat. No. 5,811,616 to separate and recover $BF_3$, in which products from polymerization enter a flash distillation/evaporation region where $BF_3$ is released and produced and then sent back to the reactor by transportation with a jet pump for continued catalytic action. This process is characterized in that the inert gases in the olefins are removed before the polymerization and $BF_3$ is the only gas released during flash distillation/evaporation which can directly returns to the polymerization reactor.

Although recover methods for complexes are disclosed in most of the above patents, there is no drying method for the complexes.

The purpose of the present invention is to provide a synthesis method for low-viscosity PAOs with low apparatus erosion rate and for stable operation of the apparatus in a long term, and to provide a process for highly efficient separation and recovery of the catalysts for low-viscosity PAO synthesis, including gaseous $BF_3$ and boron trifluoride complexes, with simply handling, low cost, and low energy consumption, in which the catalysts are recovered for recycled use such that the production cost is reduced while pollution emission is reduced.

SUMMARY

An objective of the present invention is to provide a synthesis method for low viscosity poly-α-olefin synthetic oils. In the method of present invention, the processes are simple and efficient, the utilization rate of the catalyst is improved as much as possible, the production cost is reduced, and the pollution emission is reduced.

Another objective of the present invention is to provide low viscosity poly-α-olefin synthetic oils synthesized by the above synthesis method.

To achieve these objectives, in one aspect, the present invention provides a synthesis method for low viscosity poly-α-olefin synthetic oils, comprising the following steps:

(1) dehydration treatment: the α-olefin raw material is subjected to dehydration treatment so that the water content in the raw material is ≤10 ppm;

(2) polymerization reaction: the reaction of the dehydration treated α-olefin raw material is carried out in the presence of a complex catalyst and gaseous $BF_3$ to obtain a reaction product, wherein the pressure of the gaseous $BF_3$ is 0.01 to 1 MPa;

(3) catalyst removal: the reaction product obtained in step (2) is sequentially subjected to flash distillation, gas stripping, centrifugation, and washing treatment to obtain an intermediate product, including:

a. flash distillation: the reaction product obtained in step (2) is subjected to flash distillation to obtain a first oil phase and gaseous $BF_3$;

b. gas stripping: the first oil phase obtained in step a is subjected to gas stripping to obtain a second oil phase and a stripping gas containing $BF_3$;

c. centrifugation: the second oil phase obtained in step b is subjected to separation by centrifugation using a continuous liquid-liquid separation centrifuge to obtain a recycled complex and a third oil phase;

d. washing: the third oil phase obtained in step c is subjected to alkaline washing and/or water washing to obtain an intermediate product;

(4) post-treatment: the intermediate product obtained in step (3) is subjected to distillation under reduced pressure to separate the unreacted α-olefin raw material and α-olefin dimers, and the remaining heavy fractions are subjected to hydrogenation saturation treatment followed by fractionation and cutting-off to obtain poly-α-olefin synthetic oils of different viscosity grades.

According to some particular embodiments of the present invention, the dehydration treatment in step (1) is a dehydration treatment using a zeolite fixed bed.

According to some particular embodiments of the present invention, the zeolite in the zeolite fixed bed for step (1) is an A3-A5 zeolite.

α-olefin raw materials usually contain trace amount of water, while a $BF_3$ Louis acid catalyst is highly erosive. In order to prevent as much erosion to the apparatus and piping as possible, the α-olefin raw material needs to be subjected to dehydration treatment to lower the water content thereof to less than 10 ppm, more preferably 5 ppm or less, most preferably 1 ppm or less, and the zeolite can economically and effectively remove the trace amount of water in it.

According to some particular embodiments of the present invention, the complex catalyst in step (2) has a water content of ≤10 ppm.

According to some particular embodiments of the present invention, in step (2), $BF_3$ is introduced for reaction, and the $BF_3$ introduced has a pressure of 0 to 1.0 MPa, most preferably in the range of 0.01 to 0.2 MPa.

According to some particular embodiments of the present invention, the complex catalyst in step (2) is consisted of replenished fresh complex catalyst and recycled complex catalyst.

According to some particular embodiments of the present invention, step c further includes drying treatment of the recycled complex over $B_2O_3$ so that the complex after the drying treatment has a water content of ≤100 ppm.

According to some particular embodiments of the present invention, the flash distillation process in step a is carried out under the conditions of a pressure of 0 to 0.2 MPa, most preferably a pressure in the range of 0 to 0.05 MPa, and a temperature of 0 to 100° C.

According to some particular embodiments of the present invention, step (3) includes:

a. flash distillation: the reaction product obtained in step (2) is subjected to flash distillation to obtain a first oil phase and gaseous $BF_3$, the gaseous $BF_3$ is compressed to 0.1-1.0 MPa, and 50%-98% thereof is returned to step (2) for recycled use while the remaining as purge gas is absorbed by complexation so as to provide a fresh complex catalyst;

b. gas stripping: the first oil phase obtained in step a is subjected to gas stripping to obtain a second oil phase and a stripping gas containing $BF_3$, and a portion of stripping gas containing $BF_3$ passes through the dry recycled complex where the $BF_3$ therein is absorbed by complexation, then is returned to the gas stripping section of step b for recycled use, while the recycled complex obtained after the absorption of $BF_3$ by complexation returns as recycled complex catalyst to step (2) for recycled use; the remaining portion of the stripping gas containing $BF_3$ together with the gaseous $BF_3$ as purge gas from step a are subjected to absorption by complexation, so that a fresh complex catalyst is obtained;

c. centrifugation: the second oil phase obtained in step b is subjected to separation by centrifugation using a continuous liquid-liquid separation centrifuge to obtain a recycled complex and a third oil phase; the recycled complex is dried over $B_2O_3$;

d. washing: the third oil phase obtained in step c is subjected to alkaline washing and/or water washing to obtain an intermediate product.

The reaction product is subjected to the flash distillation treatment for the purpose of preliminarily separating the $BF_3$ gas dissolved in the polymerization product, terminating the catalytic action, and recovering $BF_3$ for repeated use.

According to some particular embodiments of the present invention, the absorption by complexation in step a is absorption by complexation with a fresh initiator.

According to some particular embodiments of the present invention, the absorption by complexation in step b is absorption by complexation with the recycled complex obtained by centrifugation and drying in step c.

According to some particular embodiments of the present invention, the fresh initiator is a monobasic alcohol having a carbon atom number of 1-20 or an organic monobasic acid having a carbon atom number of 1-20.

According to some particular embodiments of the present invention, for the absorption by complexation in step a, the temperature is −50 to 50° C., and the pressure is 0 to 1.0 MPa.

According to some particular embodiments of the present invention, for the absorption by complexation in step b, the temperature is −50 to 50° C., and the pressure is 0 to 1.0 MPa.

According to some particular embodiments of the present invention, after the gaseous $BF_3$ as purge gas and the stripping gas containing $BF_3$ are subjected to absorption by complexation, the remaining gas is treated by alkaline washing and/or water washing before being discharged.

As nitrogen is normally used for maintaining pressure of the raw material, there is nitrogen included in both the gaseous and the liquid phases in the polymerization reaction system. Thus, in order to avoid influence on the reaction due to $BF_3$ partial pressure dropping caused by nitrogen accumulation in the gaseous phase, it is necessary to pressurize part of the flash distilled gas for recycled use, while the remaining part of the flash distilled gas is discharged from the recycling system as purge gas, which is highly concentrated and requires recovering treatment. In the present invention, a fresh initiator is used as an absorptive medium for absorbing the $BF_3$ in the purge gas by complexation to synthesize fresh complex catalyst which is a replenishment to the reaction system so that the loss of catalyst during the process is compensated.

According to some particular embodiments of the present invention, step b is absorption by complexation with the recycled complex obtained by centrifugation in step c.

According to some particular embodiments of the present invention, after the gaseous $BF_3$ as purge gas and the stripping gas containing $BF_3$ are subjected to absorption by complexation, the remaining gas is treated by alkaline washing and/or water washing before being discharged.

According to some particular embodiments of the present invention, the remaining gas is treated by washing with the waste water from alkaline washing and/or water washing that is discharged from the treatment of the third oil phase by alkaline washing and/or water washing in step d.

According to some particular embodiments of the present invention, the α-olefin raw material is one of or a mixture of more of straight-chain α-olefin having a carbon atom number of 8-14.

According to some particular embodiments of the present invention, the complex catalyst is a $BF_3$ complex with a monobasic alcohol having a carbon atom number of 1-20 or a $BF_3$ complex with an organic monobasic acid having a carbon atom number of 1-20.

The gaseous $BF_3$ dissolved in the polymerization product cannot be completely separated by flash distillation under positive pressure, and the complex dissociation result is also poor. Therefore, further treatment is necessary.

Treatment by gas stripping can rapidly bring the $BF_3$ gas out of the separation system and break the balance of $BF_3$ between the gaseous and liquid phases, while shift the reversible complexation reaction toward the dissociation of the complex, and facilitates the active complex to dissociate incompletely to $BF_3$ gas and the inactive complex of $BF_3$ with alcohol or acid, so that an automatic termination of the polymerization reaction is achieved, which is advantageous for subsequent separation of the complex by centrifugation and improving the recovery rate of the complex.

It is noteworthy that inert gases such as nitrogen is used for gas stripping, and the $BF_3$ gas in the stripping gas is subjected to absorption treatment with the recycled inactive complex, so that the $BF_3$ therein is removed and recycling of the stripping gas is achieved; meanwhile, the recycled complex can be reactivated to have catalytic activity and then used as catalyst for recycled use.

The usage of fresh catalyst is minimized in these embodiments.

Obviously, because of the small amount of $BF_3$ gas still dissolved in the polymerization product after flash distillation, its content in the stripping gas may exceed the complexation capacity of the recycled complex, and thus part of the stripping gas needs to be subjected to a purging treatment during stripping. In the present invention, this part of purge gas is mixed together with the purge gas from flash distillation and subjected to complexation with fresh cocatalyst, and discharged as waste gas after removing the gas therein; meanwhile, fresh catalyst is produced as a replenishment to the reaction system so that the loss of catalyst during the process is compensated.

The discharged waste gas includes a small amount of $BF_3$ gas and requires a washing treatment to thoroughly remove the fluorides therein. The present invention uses the waste alkaline liquid and/or waste water generated during the alkaline washing and/or water washing of the oil product as the washing liquid for discharged waste gas, which reduces material consumption and, on the other hand, fulfills usage of waste materials and amount of pollute emission.

The inactive complex of $BF_3$ and alcohol or acid is immiscible with the polymerization product, and phase separation tends to occur due to difference in density, and therefore they may be separated by gravimetric method. As the polymerization product has a higher viscosity, a process of separating the second oil phase and inactive complex obtained from gas stripping by using natural sedimentation is disadvantageous for its slow separation speed, long duration, and poor performance, and is not suitable for mass scale production, and therefore a centrifugal separation process is used to accelerate the separation, shorten the duration for separation, improve the separation performance, and at the same time decrease the occupied area of the separation devices.

According to some particular embodiments of the present invention, for the polymerization reaction in step (2), the reaction temperature is 0 to 100° C., the reaction duration is 0.1 to 2 h, and the reaction pressure is 0.01 to 1.0 MPa.

According to some particular embodiments of the present invention, for the polymerization reaction in step (2), the reaction duration is 0.5 to 2.0 h.

According to some particular embodiments of the present invention, for the flash distillation in step (3), the pressure is 0 to 0.2 MPa, and the temperature is 0 to 100° C.

According to some particular embodiments of the present invention, the gas used for the gas stripping in step (3) is an inert gas.

According to some particular embodiments of the present invention, the gas used for the gas stripping in step (3) is one of or a mixture of more of nitrogen, helium, argon, and neon.

According to some particular embodiments of the present invention, the inert gas for step (3) has a water content of ≤5 ppm.

According to some particular embodiments of the present invention, the gas for the gas stripping in step (3) is used in an amount such that the volume ratio between it and the first oil phase obtained by the flash distillation treatment is 0.1:1 to 10:1.

According to some particular embodiments of the present invention, for the gas stripping in step (3), the temperature is 0 to 100° C., and the pressure is 0 to 0.2 MPa.

According to some particular embodiments of the present invention, the centrifugation in step (3) is continuous centrifugation at a temperature of 0 to 100° C., a pressure of 0 to 0.2 MPa, with a rotational speed of 50 to 3000 rotation/min and a residence time of 0.1 to 10 min.

According to some particular embodiments of the present invention, after the gaseous $BF_3$ as purge gas and the stripping gas containing $BF_3$ are subjected to absorption by complexation, the remaining gas is treated by alkaline washing and/or water washing before being discharged According to some particular embodiments of the present invention, the remaining gas is treated by washing with the waste water from alkaline washing and/or water washing that is discharged after the treatment of the third oil phase by alkaline washing and/or water washing in step d.

According to some particular embodiments of the present invention, the molar ratio between the complex catalyst and the dehydration treated α-olefin raw material in step (2) is 1:50 to 1:1000.

According to some particular embodiments of the present invention, the molar ratio between the complex catalyst and the dehydration treated α-olefin raw material in step (2) is 1:100 to 1:500.

Generally, a catalyst is added in a metered amount according to the total amount of the alcohol or acid of the recycled complex catalyst and replenished fresh complex catalyst, by addition with a favorable ratio of 1:50 to 1:1000 in terms of the molar ratio between the alcohol or acid and the α-olefin raw material, most favorably 1:100 to 1:500 in terms of the molar ratio.

According to some particular embodiments of the present invention, the complex catalyst in step (2) consists of replenished fresh complex catalyst and recycled complex catalyst, wherein the ratio between the fresh complex catalyst and the recycled complex catalyst is 1:20 to 1:4.

According to some particular embodiments of the present invention, the unreacted α-olefin raw material and α-olefin dimers obtained from separation in step (4) return to step (2) for continued reactions.

The intermediate product of step (4) is distilled under reduced pressure to separate a light fraction and a heavy fraction, wherein the light fraction is unreacted monomers and α-olefin dimers which are returned to the reactor as part of the reaction raw material and continue to participate in the reaction, and the heavy fraction is subjected to hydrogenation saturation treatment followed by fractionation and cutting-off to obtain poly-α-olefin synthetic oils of different viscosity grades.

In another aspect, the present invention provides a poly-α-olefin synthetic oil obtained by synthesis using the synthesis method described above, and realizes recycled use of the catalyst to the maximum extent.

According to some particular embodiments of the present invention, the kinematic viscosity of the poly-α-olefin synthetic oil at 100° C. is 2 to 10 $mm^2/s$.

Above all, the present invention provides a poly-α-olefin synthetic oil and the synthesis method thereof. The synthetic oil of the present invention has the following advantages:

1. The present invention uses a zeolite dehydration process to remove water from the raw material, which sufficiently lowers the risk of erosion to the apparatuses and piping and can save the cost in investment.
2. The present invention uses a positive pressure flash distillation-gas stripping process, which may achieve self-termination of the polymerization and absorb the $BF_3$ in the stripping gas by using the complex recycled from centrifugal separation, such that an active complex catalyst is obtain, recycled use of the complex catalyst is achieved, catalyst usage is reduced to the maximum extent, and the production cost is reduced.
3. The present invention avoids the disadvantages of high energy consumption and occurrence of erosion of a high temperature pyrolysis process, and also prevents unwanted impurities brought in by externally added terminating agents or extracting agents, thereby simplifying subsequent processing procedures.
4. The present invention uses a centrifugal process to separate the catalyst, significantly improving the efficiency of separation, remarkably shortening the separating duration, improving production efficiency, and reducing the occupied area.
5. The present invention conducts a dehydration and drying treatment to the recycled complex, and circumvents the challenging issue of enrichment of water from the raw material in the catalyst.
6. The present invention has simple processes with convenient operation and mild processing conditions, and the operation cost may be significantly reduced.

BRIEF DESCRIPTION OF THE FIGURES

FIG. 1 is a schematic flowing chart of the processes for the synthesis of a low viscosity poly-α-olefin lubricant oil according to the present invention and recycled use of the catalyst thereof.

REFERENCE NUMBERS

1. Zeolite dehydration tower; 2. Reactor; 3. Flash distiller; 4. Gas stripping tower; 5. Centrifuge; 6. Oil product washing tower; 7. Reduced pressure distillation tower; 8. Hydrogenation rector; 9. Fractioning tower; 10. $BF_3$ storage tank; 11. Fresh catalyst complexation tank; 12. Waste gas washing tower; 13. Stripping gas complexation absorption tank; 14. Recycled complex drying device.

DETAILED DESCRIPTION

Hereinafter, the implementation and resulting advantageous effects of the present invention are described in details by means of specific examples, which is intended for readers to better understand the spirit and characteristics of the present invention, but is not to be construed as limitation to the scope of implementation of the present application.

Example 1

With reference to FIG. 1, the processes for the synthesis of a low viscosity poly-α-olefin lubricant oil according to the present invention and recycled use of the catalyst thereof particularly include the following steps:

1. A Synthesis Method for Low Viscosity Poly-α-Olefin Lubricating Oils, Particularly Comprising the Following Procedures:

Raw material refinement: the α-olefin raw material is subjected to dehydration refinement by using a zeolite fixed bed so that the water content in the raw material is ≤10 ppm;

polymerization reaction: the α-olefin raw material and the recycled light fraction are charged into a reactor, into which a recycled complex catalyst and a replenished fresh complex catalyst (with a water content of ≤10 ppm) are added, and then $BF_3$ is introduced to carry out a reaction, so as to obtain a reaction product;

catalyst separation and removal: the reaction product is sequentially subjected to flash distillation, gas stripping, centrifugation, and washing treatment to obtain an intermediate product.

(1) flash distillation: the reaction product is subjected to flash distillation to obtain a first oil phase and gaseous $BF_3$; the gaseous $BF_3$ is compressed, and a portion thereof is returned to the gaseous $BF_3$ storage tank for recycled use while the remaining is discharged as purge gas into the fresh complex catalyst tank and subjected to treatment by complexation absorption;

(2) gas stripping: the first oil phase is subjected to gas stripping to obtain a second oil phase and a stripping gas containing $BF_3$, and a portion of stripping gas containing $BF_3$ enters the recycled complex absorption tank where the $BF_3$ therein is separated by complexation absorption before recycling, while the recycled complex obtained after the absorption of $BF_3$ by complexation returns to the reactor as recycled catalyst for recycled use;

(3) centrifugation: the second oil phase obtained by gas stripping is subjected to separation by centrifugation using a continuous liquid-liquid separation centrifuge to obtain a recycled complex and a third oil phase;

(4) washing: the third oil phase is subjected to alkaline washing and/or water washing to obtain a clean intermediate product.

distillation under reduced pressure, hydrogenation, fractionation and cutting-off: the intermediate product is subjected to distillation under reduced pressure to separate the light fraction from the heavy fraction; the light fraction is unreacted monomers and α-olefin dimers, and are returned to the reactor as part of the reaction raw material and continue to participate in the reaction, and the heavy fraction is subjected to hydrogenation saturation treatment followed by fractionation and cutting-off to obtain poly-α-olefin synthetic oils of different viscosity grades.

Examples 1-2

1—decene refined by dehydration (with a water content of 4 ppm) was used as raw material to synthesize a low-viscocity PAO. Butanol (with a water content of 50 ppm) was used as a co-catalyst, at an amount of butanol:1-decene of 1:100 (molar ratio), and a reaction was carried out at 30° C. and a $BF_3$ pressure of 0.2 MPa, with a retention time of 1 h. The reaction product was subjected to flash distillation.

TABLE 1

The effect of removing $BF_3$ by flash distillation process

| Example | Temperature (° C.) | Pressure (MPa) | $BF_3$ content in oil (g/kg) Reaction product | $BF_3$ content in oil (g/kg) First oil phase | $BF_3$ removing rate (%) |
|---|---|---|---|---|---|
| 1 | 30 | 0 | 4.92 | 4.33 | 12.0 |
| 2 | 60 | 0 | 4.92 | 3.64 | 26.0 |

Examples 3-8

The flash distilled oils obtained from the processing in Examples 1 and 2 were used as the feed for gas stripping at ambient pressure and subjected to gas stripping, respectively.

TABLE 2

The effect of removing BF3 by gas stripping separation

| Example | Gas stripping conditions Temperature (° C.) | Gas stripping conditions Gas-liquid ratio (V:V) | $BF_3$ content (g/kg) First oil Phase | $BF_3$ content (g/kg) Second oil Phase | $BF_3$ removing rate (%) |
|---|---|---|---|---|---|
| 3 | 30 | 1:0.1 | 4.33 | 1.93 | 55.4 |
| 4 | 30 | 1:1 | 4.33 | 2.09 | 51.7 |
| 5 | 30 | 1:10 | 4.33 | 2.42 | 44.1 |
| 6 | 60 | 1:0.1 | 3.64 | 0.81 | 77.7 |
| 7 | 60 | 1:1 | 3.64 | 1.62 | 55.5 |
| 8 | 60 | 1:10 | 3.64 | 1.86 | 48.9 |

Examples 9-14

The second oil phase obtained in Examples 4 and 7 was subjected to centrifugal separation at ambient pressure to separate the inactive complex catalyst, and the recycled complex was subjected to dehydration.

TABLE 3

The effect of removing BF3 by centrifugal separation

| Example | Centrifuge conditions Temperature (° C.) | Centrifuge conditions Rotational speed (rotation/min) | $BF_3$ content (g/kg) Second oil phase | $BF_3$ content (g/kg) Third oil phase | $BF_3$ removing rate (%) | Water content in the recycled complex (ppm) Before dehydration | Water content in the recycled complex (ppm) After dehydration |
|---|---|---|---|---|---|---|---|
| 9 | 30 | 500 | 2.09 | 0.03 | 98.6 | 416 | 8 |
| 10 | 30 | 1000 | 2.09 | 0.02 | 99.0 | 427 | 8 |
| 11 | 30 | 2000 | 2.09 | 0.01 | 99.5 | 453 | 11 |
| 12 | 60 | 500 | 1.62 | 0.02 | 98.8 | 379 | 6 |
| 13 | 60 | 1000 | 1.62 | 0.01 | 99.4 | 414 | 9 |
| 14 | 60 | 2000 | 1.62 | 0.01 | 99.4 | 433 | 9 |

Comparative Examples 1-2

The first oil phase obtained in Examples 1 and 2 were directly subjected to centrifugal separation at ambient pressure to separate the inactive complex catalyst.

TABLE 4

Effect of first oil phase separation by centrifugation

| Comparative Examples | Centrifuge conditions Temperature (° C.) | Centrifuge conditions Rotational speed (rotation/min) | $BF_3$ content (g/kg) Before centrifugation | $BF_3$ content (g/kg) After centrifugation | $BF_3$ removing rate (%) |
|---|---|---|---|---|---|
| 1 | 30 | 1000 | 4.33 | 0.79 | 81.8 |
| 2 | 30 | 1000 | 3.64 | 0.53 | 85.4 |

Example 15

The resultant recycled complex catalyst was mixed with a fresh catalyst in a 9:1 mass ratio, and the catalyst was added into the reactor in an amount in accordance with a ratio between the catalyst and the olefin raw material of 1:100 (molar ratio, calculated in terms of the butanol therein). Meanwhile, the gaseous $BF_3$ in the recycling tank was used as replenishing gas to control the pressure in the reactor at 0.2 MPa, and a PAO synthesis reaction was carried out under the condition of a reaction temperature at 30° C., and the product composition was compared with that obtained by a reaction catalyzed by the fresh catalyst under the same condition:

TABLE 5

Impact of the times of recycled usage of the recycled catalyst on the product composition

| Rounds of recycled usage of the catalyst | | Distribution of the polymerization product composition (wt, %) | | | | | | | |
|---|---|---|---|---|---|---|---|---|---|
| | | Monomer | Dimer | Trimer | Tetramer | Pentamer | Hexamer or above | Conversion rate (%) | Yield (%) |
| Fresh | | 0.6 | 3.8 | 55.7 | 26.0 | 11.3 | 2.7 | 99.4 | 95.7 |
| Recycled catalyst | 1 | 0.5 | 3.5 | 56.1 | 26.1 | 11.2 | 2.6 | 99.5 | 96.0 |
| | 2 | 0.5 | 3.2 | 56.6 | 25.9 | 11.1 | 2.7 | 99.5 | 96.3 |
| | 3 | 0.4 | 3.3 | 56.5 | 26.4 | 11.0 | 2.8 | 99.6 | 96.4 |

Example 16

The third oil phase obtained in Example 11 was subjected to alkaline washing and water washing with an alkaline solution at a concentration of 0.01% and a volume ratio between the alkaline solution and the third oil phase of 1:1. Then, the oil after alkaline washing was subjected to washing with desalted water, and the fluoride content in the oil was determined as 0.3 ppm, with the $F^-$ concentration in the alkaline solution of 12 ppm and the $F^-$ concentration in water of 0.8 ppm.

What is claimed is:

1. A synthesis method for low viscosity poly-α-olefin lubricating oils, comprising the following steps:

(1) dehydration treatment: an α-olefin raw material is subjected to dehydration treatment so that a water content in a dehydrated α-olefin raw material is ≤10 ppm;

(2) polymerization reaction: a polymerization reaction of the dehydrated α-olefin raw material is carried out in the presence of a complex catalyst and gaseous $BF_3$ to obtain a reaction product, wherein the pressure of the gaseous $BF_3$ is 0.01 to 1 MPa;

(3) catalyst removal: the reaction product obtained in step (2) is sequentially subjected to flash distillation, gas stripping, centrifugation, and washing treatment to obtain an intermediate product, including:

a. flash distillation: the reaction product obtained in step (2) is subjected to flash distillation to obtain a first oil phase and gaseous $BF_3$;

b. gas stripping: the first oil phase obtained in step a is subjected to gas stripping to obtain a second oil phase and a stripping gas containing $BF_3$;

c. centrifugation: the second oil phase obtained in step b is subjected to separation by centrifugation using a continuous liquid-liquid separation centrifuge to obtain a recycled complex catalyst and a third oil phase; the recycled complex is dried over $B_2O_3$ so that the water content in the complex after drying is ≤100 ppm;

d. washing: the third oil phase obtained in step c is subjected to alkaline washing and/or water washing to obtain an intermediate product;

(4) post-treatment: the intermediate product obtained in step (3) is subjected to distillation under reduced pressure to separate the unreacted α-olefin raw material and α-olefin dimers, and the remaining heavy fractions are subjected to hydrogenation saturation treatment followed by fractionation and cutting-off to obtain poly-α-olefin synthetic oils of different viscosity grades.

2. The synthesis method according to claim 1, wherein the complex catalyst in step (2) has a water content of ≤10 ppm.

3. The synthesis method according to claim 1, wherein the complex catalyst in step (2) is consisted of replenished fresh complex catalyst and recycled complex catalyst, wherein the ratio between the fresh complex catalyst and the recycled complex catalyst is 1:20 to 1:4.

4. The synthesis method according to claim 1, wherein step (3) includes:

a. flash distillation: the reaction product obtained in step (2) is subjected to flash distillation to obtain a first oil phase and gaseous $BF_3$, the gaseous $BF_3$ is compressed to 0.1-1.0 MPa, and 50%-98% thereof is returned to step (2) for recycled use while the remaining as purge gas is absorbed by complexation so as to provide a fresh complex catalyst;

b. gas stripping: the first oil phase obtained in step a is subjected to gas stripping to obtain a second oil phase and a stripping gas containing $BF_3$, and a portion of stripping gas containing $BF_3$ passes through a dry recycled complex catalyst where the $BF_3$ therein is absorbed by complexation, then is returned to a gas stripping section of step b for recycled use, while the recycled complex catalyst obtained after the absorption of $BF_3$ by complexation returns as recycled complex catalyst to step (2) for recycled use; the remaining portion of the stripping gas containing $BF_3$ together with the gaseous $BF_3$ as purge gas from step a are subjected to absorption by complexation, so that a fresh complex catalyst is obtained;

c. centrifugation: the second oil phase obtained in step b is subjected to separation by centrifugation using a continuous liquid-liquid separation centrifuge to obtain a recycled complex catalyst and a third oil phase; the recycled complex catalyst is dried over $B_2O_3$;

d. washing: the third oil phase obtained in step c is subjected to alkaline washing and/or water washing to obtain an intermediate product.

5. The synthesis method according to claim 4, wherein the absorption by complexation in step a is absorption by complexation with a fresh initiator; the absorption by complexation in step b is absorption by complexation with the recycled complex obtained by centrifugation and drying in step c.

6. The synthesis method according to claim 5, wherein the fresh initiator is a monobasic alcohol having a carbon atom number of 1-20 or an organic monobasic acid having a carbon atom number of 1-20.

7. The synthesis method according to claim 4, wherein for the absorption by complexation in steps a and b, the temperature is each independently −50 to 50° C., and the pressure is each independently 0 to 1.0 MPa.

8. The synthesis method according to claim 4, wherein after the gaseous $BF_3$ as purge gas and the stripping gas containing $BF_3$ are subjected to absorption by complexation, a remaining gas is treated by alkaline washing and/or water washing before being discharged.

9. The synthesis method according to claim 8, wherein the remaining gas is treated by washing with the waste water from alkaline washing and/or water washing that is discharged from the treatment of the third oil phase by alkaline washing and/or water washing in step d.

10. The synthesis method according to claim 1, wherein the α-olefin raw material is one of or a mixture of more of straight-chain α-olefin having a carbon atom number of 8-14.

11. The synthesis method according to claim 1, wherein the complex catalyst is a $BF_3$ complex with a monobasic alcohol having a carbon atom number of 1-20 or a $BF_3$ complex with an organic monobasic acid having a carbon atom number of 1-20.

12. The synthesis method according to claim 1, wherein for the polymerization reaction in step (2), the reaction temperature is 0 to 100° C., the reaction duration is 0.1 to 2 h, and the reaction pressure is 0.01 to 1.0 MPa.

13. The synthesis method according to claim 1, wherein for the flash distillation in step (3), the pressure is 0 to 0.2 MPa, and the temperature is 0 to 100° C.

14. The synthesis method according to claim 1, wherein the gas used for the gas stripping in step (3) is an inert gas; and the gas for the gas stripping is used in an amount such that the volume ratio between it and the first oil phase obtained by the flash distillation treatment is 0.1:1 to 10:1.

15. The synthesis method according to claim 14, wherein the inert gas has a water content of ≤5 ppm.

16. The synthesis method according to claim 1, wherein for the gas stripping in step (3), the temperature is 0 to 100° C., and the pressure is 0 to 0.2 MPa.

17. The synthesis method according to claim 1, wherein the centrifugation in step (3) is continuous centrifugation at a temperature of 0 to 100° C., a pressure of 0 to 0.2 MPa, with a rotational speed of 50 to 3000 rotation/min and a residence time of 0.1 to 10 min.

18. The synthesis method according to claim 1, wherein the molar ratio between the complex catalyst and the dehydrated α-olefin raw material in step (2) is 1:50 to 1:1000.

19. The synthesis method according to claim 1, wherein the unreacted α-olefin raw material and α-olefin dimers obtained from separation in step (4) return to step (2) for continued reactions.

* * * * *